US009348249B2

(12) United States Patent
Ikuta et al.

(10) Patent No.: US 9,348,249 B2
(45) Date of Patent: May 24, 2016

(54) IMAGE FORMING APPARATUS AND IMAGE FORMING AND DECOLORING SYSTEM

(71) Applicant: TOSHIBA TEC KABUSHIKI KAISHA, Tokyo (JP)

(72) Inventors: Masahiro Ikuta, Mishima Shizuoka (JP); Kazuhisa Takeda, Kannami Shizuoka (JP); Tsuyoshi Itou, Izunokuni Shizuoka (JP); Yasuhito Noda, Mishima Shizuoka (JP); Takayasu Aoki, Mishima Shizuoka (JP); Takafumi Hara, Nagaizumi Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/341,609

(22) Filed: Jul. 25, 2014

(65) Prior Publication Data

US 2016/0026108 A1 Jan. 28, 2016

(51) Int. Cl.
*G03G 15/01* (2006.01)

(52) U.S. Cl.
CPC ..... *G03G 15/0121* (2013.01)

(58) Field of Classification Search
CPC ..... G03G 15/6585; G03G 15/0121; G03G 15/0194; G03G 15/0821
USPC ..... 399/223
See application file for complete search history.

(56) References Cited

U.S. PATENT DOCUMENTS

| | | | | |
|---|---|---|---|---|
| 5,571,652 | A * | 11/1996 | Asano et al. | 430/110.2 |
| 7,945,189 | B2 | 5/2011 | Yamashita | |
| 8,486,598 | B2 | 7/2013 | Aoki et al. | |
| 2008/0261143 | A1* | 10/2008 | Yamashita | 430/125.3 |
| 2011/0165509 | A1* | 7/2011 | Aoki et al. | 430/124.1 |
| 2014/0057201 | A1 | 2/2014 | Kabai et al. | |
| 2014/0072909 | A1 | 3/2014 | Kabai et al. | |

* cited by examiner

*Primary Examiner* — Walter L Lindsay, Jr.
*Assistant Examiner* — Frederick Wenderoth
(74) *Attorney, Agent, or Firm* — Patterson & Sheridan, LLP

(57) ABSTRACT

According to one embodiment, there is provided an image forming apparatus which forms an decolorable image and an non-decolorable image by fixing a toner image including a decolorable toner and a toner image including a non-decolorable toner or a medium. The decolorable toner has a first peak of a loss tangent tan δ at a temperature $T_{E1}$, and the non-decolorable toner has a first peak of a loss tangent tan δ at a temperature $T_{U1}$. A difference between the temperature $T_{E1}$ and the temperature $T_{U1}$ is within 20° C.

15 Claims, 3 Drawing Sheets

IMAGE FORMING APPARATUS AND IMAGE FORMING AND DECOLORING SYSTEM

BACKGROUND

In recent years, in the office environment, with the spread of computers, software, and networks, the amount of information available in the office has increased, and the amount thereof printed on print media, such as paper sheets, has also increased. In order to avoid the deterioration of the global environment due to cutting down of trees for use as the raw material to create paper, and to decrease the amount of $CO_2$ generated in that production and the reduction of $CO_2$ absorption when trees are cut down, reuse and recycling of paper sheets are desirable.

For example, a toner with decolorable property such as an electrophotographic toner including a coloring compound is known (JP-A-2010-191430, JP-A-2011-158901). A decolorable toner allows reuse of paper sheets since it is possible to erase, i.e., decolor and thus render non-visible to the human eye, the image printed on the paper. This process is known in the art as "decoloring". However, such decoloring apparatus may not be used in conjunction with a non-decolorable toner. Thus, an apparatus which may use an ordinary non-decolorable toner together with such decolorable toner in one image forming apparatus is desired.

If the physical properties of the non-decolorable toner are sufficiently similar to the characteristics of the decolorable toner, it is possible to eliminate extreme temperature variations when fixing the decolorable and non-decolorable toner in the image forming apparatus, and it is possible to expect to efficiently print images using either the decolorable toner or the non-decolorable toner, or the decolorable toner or the non-decolorable toner together, in the same printing apparatus.

DETAILED DESCRIPTION

Embodiments provide an image forming apparatus which may effectively form an image using either decolorable toner and non-decolorable toner, and an image forming and erasing system which may effectively erase a decolorable image.

In general, according to one embodiment, there is provided an image forming apparatus which forms an decolorable image and a non-decolorable image by fixing a toner image including a decolorable toner and a toner image including a non-decolorable toner on a medium, in which the decolorable toner has a first peak of a loss tangent tan δ at a temperature $T_{E1}$, the non-decolorable toner has a first peak of the loss tangent tan δ at a temperature $T_{U1}$, and a difference in temperature between the temperature $T_{E1}$ and the temperature $T_{U1}$ is less than or equal to 20° C.

In addition, according to another embodiment, there is an image forming and erasing system which forms an decolorable first image and a non-decolorable second image by fixing a toner image including a decolorable toner and a toner image including a non-decolorable toner on a medium, and decolors the first image on the medium by heating, in which in the decolorable toner, a temperature at which a storage modulus G' becomes $1\times10^4$ is $T_{E2}$, in the non-decolorable toner, a temperature at which the storage modulus G' becomes $1\times10^4$ is $T_{U2}$, and a difference in temperature between the temperature $T_{E2}$ and the temperature $T_{U2}$ is less than or equal to 55° C.

In addition, according to still another embodiment, there is an image forming and erasing system which forms an decolorable first image and a non-decolorable second image by fixing the toner image including a decolorable toner and the toner image including a non-decolorable toner on a medium, and decolors the first image on the medium by heating, in which the decolorable toner has a first peak of a loss tangent tan δ at a temperature $T_{E1}$, a temperature at which a storage modulus G' becomes $1\times10^4$ in the decolorable toner is $T_{E2}$, the decolorable toner has a first peak of the loss tangent tan δ at a temperature $T_{E1}$, the non-decolorable toner has a first peak of the loss tangent tan δ at a temperature $T_{U1}$, a difference in temperature between the temperature $T_{E1}$ and the temperature $T_{U1}$ is less than or equal to 20° C., in the decolorable toner, a temperature at which the storage modulus G' becomes $1\times10^4$ is $T_{E2}$, and in the non-decolorable toner, a temperature at which the storage modulus G' becomes $1\times10^4$ is $T_{U2}$, and a difference in temperature between the temperature $T_{E2}$ and the temperature $T_{U2}$ is within 55° C.

Hereinafter, embodiments will be described with reference to the drawings.

Figure 1:
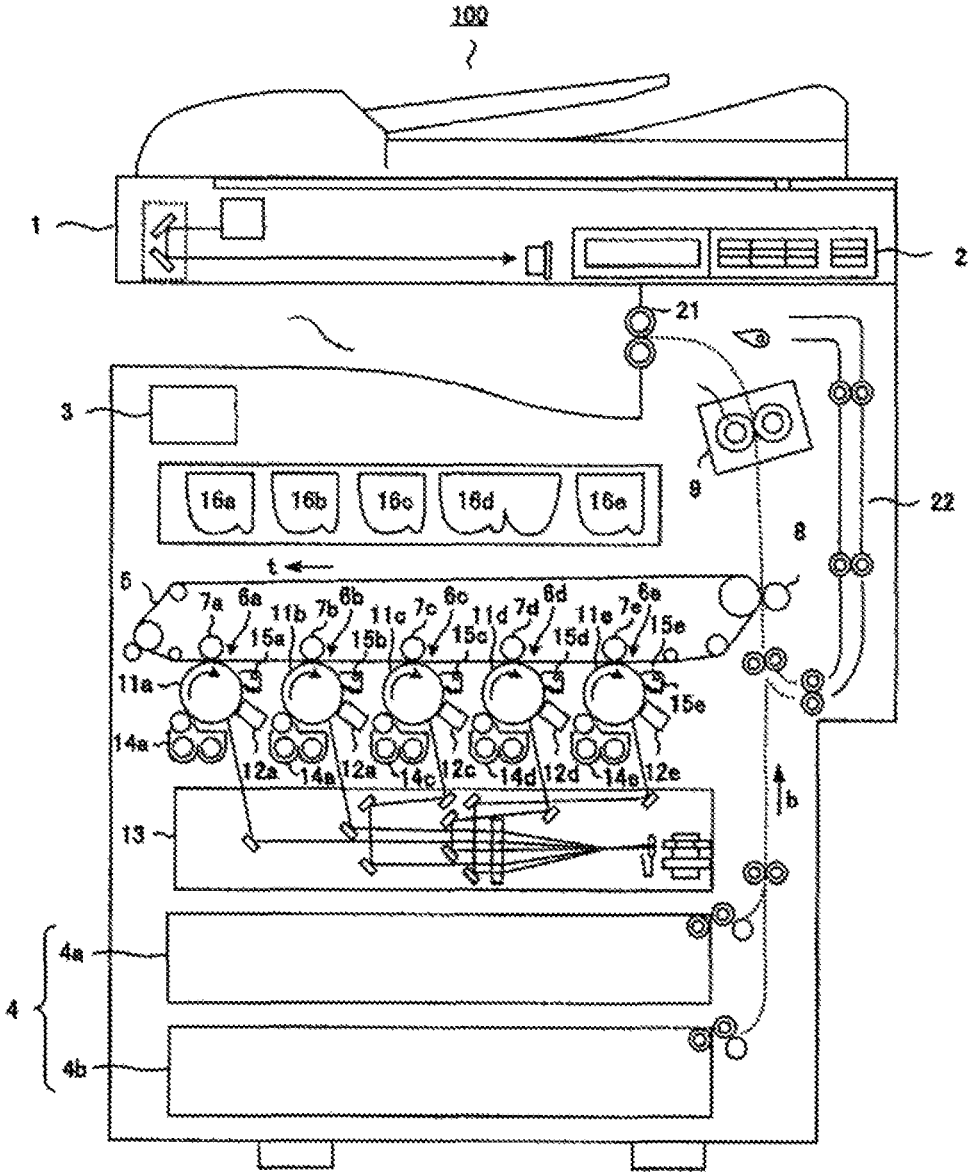
FIG. 1 is a schematic view illustrating a configuration example of an image forming apparatus according to an exemplary embodiment.

FIG. 1 is a schematic configuration view illustrating an image forming apparatus according to an exemplary embodiment. The image forming apparatus shown in the drawing may be also used in an image forming and decoloring system according to an exemplary embodiment. MFP (Multi Functional Peripheral) 100 is the image forming apparatus using a tandem process. MFP 100 is provided with a scanner 1 which scans an original document of an upper portion, a control panel 2 in an operating portion accessible to a user, and a control portion 3 which controls the overall operation process of the MFP 100. A sheet feeding portion 4 is arranged below the MFP 100. For example, the sheet feeding portion 4 has sheet accommodating portions (trays) 4*a* and 4*b* which can accommodate sheets of different sizes as a print medium. An intermediate transfer belt 5 movable in the direction of an arrow t illustrated in FIG. 1, and five image forming portions 6*a*, 6*b*, 6*c*, 6*d*, and 6*e* arranged around the intermediate transfer belt 5 are located between the scanner 1 and the sheet feeding portion 4.

The image forming portions 6*a*, 6*b*, 6*c*, 6*d*, and 6*e* form an image with a decolorable blue toner which is a decoloring recording material having a decoloring function (hereinafter, referred to as "E toner"), a non-decolorable yellow toner which is a non-decoloring recording material not having the decoloring function (hereinafter, referred to as "Y toner"), a non-decolorable magenta toner (hereinafter, referred to as "M toner"), a non-decolorable cyan toner (hereinafter, referred to as "C toner"), and a non-decolorable black toner (hereinafter, referred to as "BK toner"), respectively. Here, the image forming portion 6*a* including the decolorable toner is a first image forming portion, and the image forming portions 6*b*, 6*c*, 6*d*, and 6*e*, including a non-decolorable toner is a second image forming portion.

Moreover, the decolorable toner is decolored when reaching a certain temperature (decolorable temperature) by being heated, and it is possible to cause a reversible coloring and decoloring reaction at specific temperatures (color-recovering temperature) or lower when the temperature is decreased. The components of the decolorable toner and manufacturing method thereof will be described in detail with the non-decolorable toner.

Transfer rollers 7*a*, 7*b*, 7*c*, 7*d*, and 7*e* press the intermediate transfer belt against, the drums 11*a-e* of image forming portions 6*a-e*, thus enabling transfer of a toner image formed by the image forming portions 6*a*, 6*b*, 6*c*, 6*d*, and 6*e* onto the intermediate transfer belt 5 as it passes. Secondary transfer rollers 8 arranged downstream of the image forming portion 6*e* along the movement direction of the intermediate transfer belt 5 squeeze together the transfer belt and a sheet passing therethrough to transfer a toner image formed by at least one of the image forming portions 6*a*, 6*b*, 6*c*, 6*d*, and 6*e* on the intermediate transfer belt 5 onto a sheet fed from the sheet feeding portion 4. A fixing portion 9 for fixing the toner image to the sheet is arranged downstream of the secondary transfer roller 8 along the traveling direction (the direction of an arrow b illustrated in FIG. 1) of the sheet fed from the sheet feeding portion 4.

The fixing portion 9 is provided with a heat transport member 9*a* for nipping and transporting the sheet on which the toner image is transferred. The heat transport member 9*a* fixes the toner image to the sheet by heating the sheet on which the toner image is transferred to a predetermined fixing temperature. In order to fix the toner image to the sheet at the fixing portion 9, a temperature higher than the glass transition temperature $T_g$ of a binder resin included in the toner, and around the softening point temperature $T_m$ of the toner, is generally required. If the fixing temperature is lower than the decolorable temperature of the decolorable toner, when fixing a toner image which includes decolorable toner to the sheet, the color of the toner image is not decolored, i.e., it is visible.

Since the configuration of the image forming portions 6*a*, 6*b*, 6*c*, 6*d*, and 6*e* are common except for the toner accommodated therein, the configuration of the image forming portions 6*a*, 6*b*, 6*c*, 6*d*, and 6*e* will be described by the example of the image forming portion 6*a*.

The image forming portion 6*a* has a photoconductor drum 11*a* as an image carrier. Around the photoconductor drum 11*a*, a charger 12*a* for charging the photoconductor drum 11*a*, an exposure device 13 for irradiating a scanning line of a laser beam on the charged photoconductor drum 11*a* in accordance with the image information, and a developing device 14*a* which contains the decolorable E toner and develops an electrostatic latent image formed by the exposure device 13 are arranged. Further, the image forming portion 6*a* has a cleaning device 15*a* for removing the toner remaining on the photoconductor drum 11*a* after the toner image on the photoconductor drum 11*a* is transferred to the transfer belt 5.

In the same manner, the image forming portions 6*b*, 6*c*, 6*d*, and 6*e* have the photoconductor drums 11*b*, 11*c*, 11*d*, and 11*e*, the chargers 12*b*, 12*c*, 12*d*, and 12*e*, the exposure device 13, the developing devices 14*b*, 14*c*, 14*d*, and 14*e*, and the cleaning devices 15*b*, 15*c*, 15*d*, and 15*e*. The toner accommodated in the developing device 1'4*b* is the non-decolorable Y toner, the toner accommodated in the developing device 14*c* is the non-decolorable M toner, the toner accommodated in the developing device 14*d* is the non-decolorable C toner, and the toner accommodated in the developing device 14*e* is the non-decolorable BK toner.

In the developing devices 14*a*, 14*b*, 14*c*, 14*d*, and 14*e*, each accommodated toner concentration is detected, and in accordance with the toner concentration, the toner is supplied from toner cartridges 16*a*, 16*b*, 16*c*, 16*d*, and 16*e* corresponding to the toner which each developing device accommodates.

The image forming portions 6*a*, 6*b*, 6*c*, 6*d*, and 6*e* may be changed depending on an image forming (hereinafter, also referred to as "printing") type, that is, printing by the decolorable toner having the decoloring function, and by the non-decolorable toner not having the decoloring function. When printing with the decolorable toner having the decoloring function, in order to prevent color mixing with the non-decolorable toner, the image forming portion 6*a* (photoconductor drum 11*a*) comes into contact with the intermediate transfer belt 5, and the image forming portions 6*b*, 6*c*, 6*d*, and 6*e* (photoconductor drums 11*b*, 11*c*, 11*d* and 11*e*) do not come into contact with the intermediate transfer belt 5. When printing with the decolorable toner having the decoloring function, the temperature of the fixing portion 9 (hereinafter, referred to as the fixing temperature) is lower than the decolorable temperature of the decolorable toner, and is maintained at a fixing temperature of the decolorable toner.

On the other hand, when printing with the non-decolorable toner not having the decoloring function, the image forming portions 6*b*, 6*c*, 6*d*, and 6*e* (photoconductor drum 11*b*, 11*c*, 11*d*, and 11*e*) come into contact with the intermediate transfer belt 5, and the decolorable image forming drum 11*a* does not. In this case, the temperature of the fixing portion 9 is maintained at a temperature which is not lower than the fixing temperature of the non-decolorable toner. If a fixing temperature range of the non-decolorable toners is not significantly different from a fixing temperature of the decolorable toner, when fixing each toner, it is not necessary to extremely vary the temperature of the fixing portion. In the exemplary embodiment, the decolorable and non-decolorable toners are selected such that a viscoelastic property of the decolorable toner and the non-decolorable toner is in a predetermined range, and large temperature variations when fixing may be prevented.

In the fixing portion 9, a first decolorable image formed with the decolorable toner and a second non-decolorable image formed with the non-decolorable toner are formed on the sheet.

A flapper (bifurcation member) is provided at the downstream of the fixing portion 9, the flapper is configured to block or unblock a transfer path and thus direct a sheet in the direction of a sheet discharge roller 21 or in the direction of a retransport unit 22. A sheet introduced to the sheet discharge roller 21 is discharged to a sheet discharging portion 23. In addition, the sheet introduced to the retransport unit 22 is again introduced in the direction of the secondary transfer roller 8.

Moreover, since the image forming apparatus illustrated in FIG. 1 is a color MFP, the image forming portions 6*b*, 6*c*, 6*d*, and 6*e* using the non-decoloring recording material are included in the second image forming portion, and the image forming apparatus may also be configured to have, or to use, only the image forming portions 6*a* and 6*e*, using only the decolorable E toner and the non-decolorable BK toner.

In the embodiment described above, the toners are described as the decolorable recording material and the non-decolorable recording material, and it is also possible to use a liquid ink, a gel-state ink or an ink ribbon to print images on sheets in accordance with the form of the image forming apparatus. In addition, the MFP 100 of the embodiment may be configured to have the function of a decoloring apparatus 200 described later.

In this case, the MFP 100 itself is referred to as the image forming and decoloring system, and in the fixing portion 9 included in the MFP 100, it is possible to decolor images formed of a decolorable recording material formed on a sheet.

In the sheet printed with the decolorable recording material using the image forming apparatus such as the MFP 100, for example, by using an image decoloring apparatus 200 described below, it is possible to decolor the image or portion of the image formed of the decolorable recording material on the sheet. When the image decoloring apparatus 200 is used, by the above-described MFP 100 and the decoloring apparatus 200, the image forming and erasing system is configured.

Figure 2:
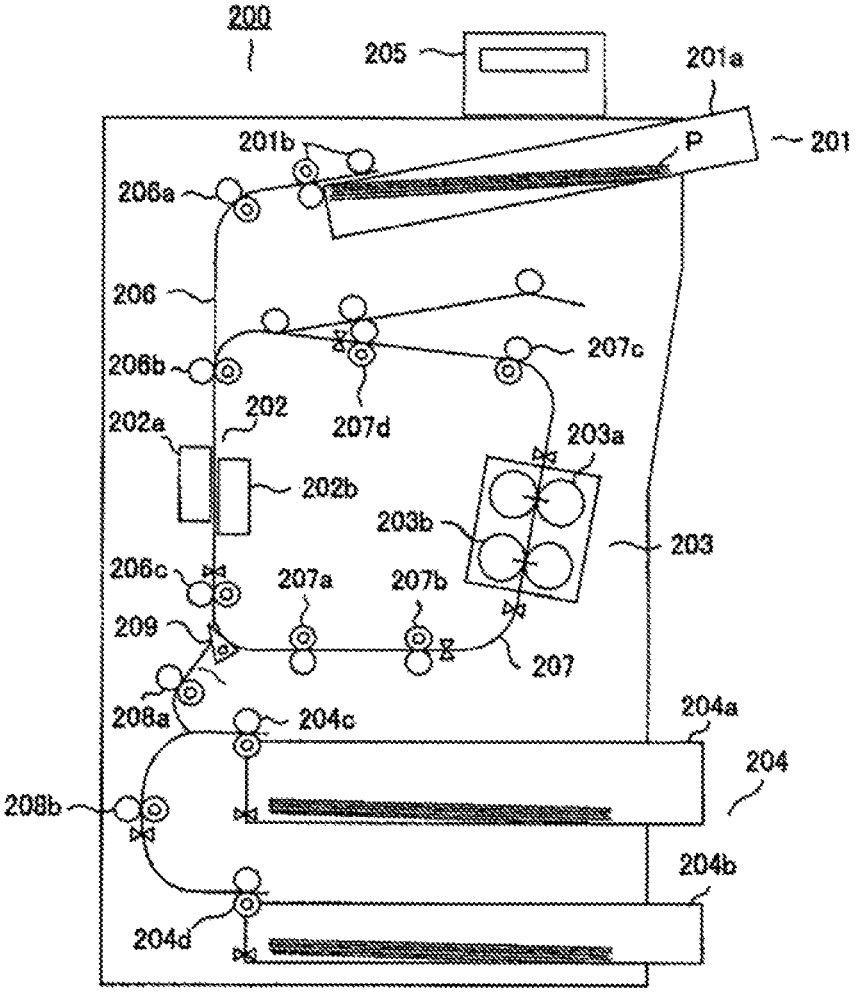
FIG. 2 is a schematic view illustrating a configuration example of an image decoloring apparatus in an image forming and erasing system according to an exemplary embodiment.

FIG. 2 is a schematic view illustrating the entire configuration of the decoloring apparatus 200. For example, the image decoloring apparatus 200 is an apparatus which decolors the decolorable image material on a sheet P which was printed with the above-described decolorable recording material of the image forming apparatus 100, for example, the decolorable toner or the decolorable ink by heating or the like. The image decoloring apparatus 200 is provided with an operation portion 205 for operating a sheet feeding portion 201, a reading portion 202, a decoloring portion 203, a discharged sheet storage portion 204 and the process of decoloring using the decoloring apparatus 200.

The sheet feeding portion 201 is provided with a sheet feeding tray 201*a* and a sheet feeding and transport roller 201*b*. In the sheet feeding tray 201*a*, a sheet P which has been printed with a decolorable recording material is stacked. In some cases, a sheet printed with a non-decolorable recording material is also stacked in the sheet feeding tray 201*a*. The sheet P is sent to a first transport path 206 through the sheet feeding and transport roller 201*b*, and sent to the reading portion 202 through the transport rollers 206*a* and 206*b*.

The reading portion 202 is provided with a surface reading portion 202*a* for reading the surface (first surface) of the sheet P transported and a back surface reading portion 202*b* for reading the back surface (second surface) of the sheet P. Information read here is stored in the decoloring apparatus. Alternatively, the information read is stored in another storage apparatus through a communication line.

The sheet P passes through the reading portion 202, passes through a transport roller 2060, is directed to a second transport path 207 by the position of a flapper (bifurcation member) 209, and is sent to the decoloring portion 203 through transport rollers 207*a* and 207*b*.

The decoloring portion 203 is provided with first and second heat transport members 203*a* and 203*b* together forming a nip therebetween and transporting the sheet P therethrough. The first and the second heat transport members 203*a* and 203*b* decolor the color of the image printed on the sheet P by heating the sheet P to a predetermined decoloring temperature. In order to decolor the decolorable toner, it is necessary to heat the image to a decoloring temperature of the decolorable toner.

The temperature of the decoloring portion 203 of the decoloring apparatus 200 is higher than the fixing temperature of the fixing portion in the image forming apparatus, and when decoloring, it is preferred to avoid hot offset of the toner. The hot offset is necessary to be considered with respect to both the decolorable toner and the non-decolorable toner. The offset will be described below, and in the embodiment, by setting the viscoelastic property of the decolorable toner and the non-decolorable toner in a predetermined range, it is possible to avoid hot offset when decoloring.

The sheet P passed through the decoloring portion 203 is transported again to the reading portion 202 through the transport rollers 207*c*, 207*d* and 206*b*. Here, the sheet P is read again, it is determined whether the sheet is reusable or not, and is considered reusable if it is without non-decolored portions thereon or damage, creasing or tearing of the sheet.

The discharged sheet storage portion 204 is provided with a reusable sheet storage tray 204*a* and an unreusable sheet storage tray 204*b*. The sheet P, read again in the reading portion 202, passes through the transport roller 206*c*, and is directed to a third transport path 208 by the position of a flapper (bifurcation member) 209. A sheet P1 determined to be reusable passes through transport rollers 208*a*, and is discharged to the reusable sheet storage tray 204*a* through sheet discharging and transport rollers 204*c* by a flapper. On the other hand, a sheet P2 determined to be not reusable is reversed by the sheet discharging and transport rollers 204*c*, and is discharged to a non-reusable sheet storage tray 204*b* through the transport rollers 208*b*, and the sheet discharging and transport rollers 204*d*.

Moreover, the position of the reusable sheet storage tray 204*a* and the non-reusable sheet storage tray 204*b* may also be exchanged each other, such that reusable sheets are directed to storage tray 204*b*, and non-reusable sheets are directed to storage tray 204*a*. The setting of the transport destination of the sheet P, for example, may be set at the operation portion 205.

When forming an image on a sheet using the image forming apparatus illustrated in FIG. 1, in the fixing portion 9, both the decolorable toner and the non-decolorable toner are required to have sufficient image density, without the fixing portion heating the image to the point where the decolorable toner is decolored. A fixing temperature range in which sufficient image density may be ensured is referred to as a fixing range.

In recent years, fixing is performed at a lower temperature, and, widening the fixing range is not easy. In addition, the non-offset temperature of a high temperature side of the fixing range of toners has also been lowered. The term "offset" refers to transfer of toner to a heat transport member such as a roller. In particular, when the surface temperature of the roller is lower than the melting point of the toner, the transfer is referred to as a cold offset, and when the surface temperature of the roller is higher than the melting point of the toner, the transfer is referred to as hot offset.

When cold offset occurs, a toner image is not favorably fixed, and sufficient image density may not be obtained on a sheet. Varying the temperature of the fixing portion in order to avoid the cold offset of any one toner may lead to a decrease in the efficiency of printing. When hot offset occurs, by a transfer of the toner to the roller, sufficient image density may not be obtained on sheet.

In the exemplary embodiment, when combining the decolorable toner and the non-decolorable toner, by establishing the dynamic viscoelastic property of the toners to a predetermined condition, it is possible to suppress extreme temperature variations when fixing. When forming an decolorable image using decolorable toner and a non-decolorable image using non-decolorable toner in the same apparatus, it is possible to efficiently perform printing using the decolorable toner and the non-decolorable toner at the same time with proper selection of toner viscoelastic properties. If decoloring of a decolorable image and an image formed by the non-decolorable toner are performed at the same time, or a printing speed is changed, it is possible to change to a decolorable toner printing temperature without requiring time to change properties of the fixing process. In addition, in combination of the decolorable toner and the non-decolorable toner, if the selection of a dynamic viscoelastic modulus of the toners is further refined, it is possible to avoid occurrence of the hot offset when decoloring the erasable image.

The present inventors have found that when using decolorable toner and non-decolorable toner in the same image forming apparatus, it is possible to fix each toner while avoiding excessive difference in fixing temperatures thereof, by proper selection and control of the dynamic viscoelastic property of the different toners. The dynamic viscoelastic property of the toner will be described below.

As disclosed in JP-A-2011-232552, JP-A-2012-150466, and JP-A-2013-15673, the storage modulus (G') of the viscoelastic property, a loss modulus (G"), and the loss tangent tan δ (G"/G') which is a ratio both moduli are known as an indicator to control a fixing performance of the toner.

The storage modulus (G') represents elasticity, and is an indicator of the force stored to return to an original state when being deformed by an exterior force. On the other hand, the loss modulus (G") represents viscosity, and is an indicator of the force lost as heat when an exterior force is imposed. In addition, tan 6 represented by the loss modulus (G")/(G") where the storage modulus (G') represents the balance between the viscosity and the elasticity.

Figure 3:
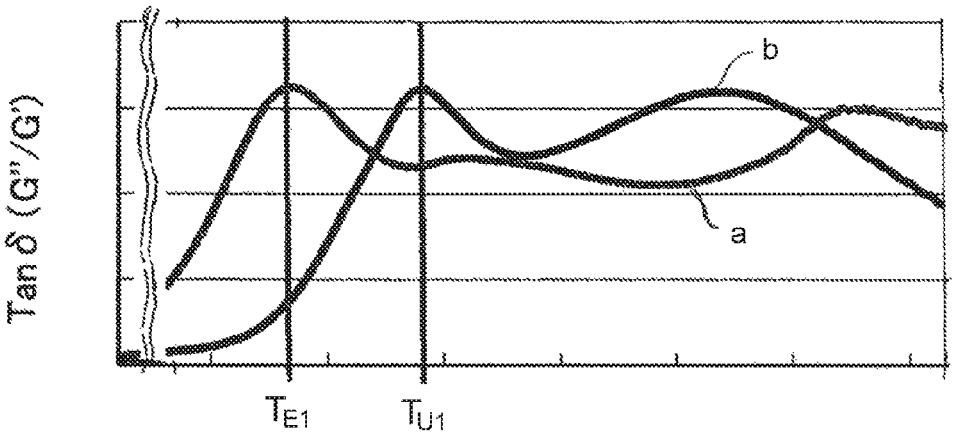
FIG. 3 is a graph illustrating an example of a loss tangent tan δ of a decolorable toner and a non-decolorable toner used in an exemplary embodiment.

The present inventors thought that a temperature at which the first peak of tan δ appears is an indicator of the temperature (lowest fixing temperature) at which molecular motion of the toner begins, and thus fixing begins, and focused on the changes in the loss tangent tan δ of the decolorable toner and the non-decolorable toner in the image forming apparatus of the embodiment. One example of the changes in the loss tangent tan δ of the decolorable toner and the non-decolorable toner is illustrated in FIG. 3. In FIG. 3, the curve a represents the change in the loss tangent tan δ of the decolorable toner, and a curve b represents the change in the loss tangent tan δ of the non-decolorable toner.

As shown in the curve a, tan δ of the decolorable toner has the first peak at the temperature $T_{E1}$, and tan δ of the non-decolorable toner has the first peak at the temperature $T_{U1}$. In the embodiment, a difference between the temperatures $T_{E1}$ and $T_{U1}$ ($|T_{E1}-T_{U1}|$) is set to within 20° C.

If the difference between the temperatures $T_{E1}$ and $T_{U1}$ ($|T_{E1}-T_{U1}|$) is within 20° C., the difference is within an allowable range, and it is possible to fix the decolorable toner and the non-decolorable toner in the same temperature range. However, if the difference between the temperatures $T_{E1}$ and $T_{U1}$ ($|T_{E1}-T_{U1}|$) is greater than 20° C., the difference of a fixing starting temperature becomes too wide. In order to set the fixing temperature of the fixing portion to the fixing starting temperature of each toner, excessive temperature variation of the fixing temperature is required. As a result, when shifting from a printing mode for the non-decolorable toner to a printing mode for the decolorable toner, a waiting period while the fixing temperature is adjusted is required. When shifting from the printing mode for the decolorable toner to the printing mode for the non-decolorable toner, in the same manner, the waiting period to adjust the fixing temperature is also required. This causes a decrease in the efficiency of printing.

According to the embodiment, since the difference between the fixing temperature of the decolorable toner and the fixing temperature of the non-decolorable toner is set within a predetermined range, it is not necessary to change the fixing temperature of the fixing portion in accordance with the type of toner being fixed. In this manner, it became possible to efficiently perform printing using both the decolorable toner and the non-decolorable toner in the same image forming device.

Moreover, with an increase in printing speed, the fixing temperature also tends to increase. During fixing, it is difficult to maintain the desired image density of an image when approaching the decoloring temperature of the decolorable toner, and therefore, there is restriction on the printing speed of the decolorable toner. On the other hand, the non-decolorable toner is not decolored even when the fixing temperature rises. For this reason, the printing speed in case of using the decolorable toner should be slower than the printing speed in case of using the non-decolorable toner.

Figure 4:
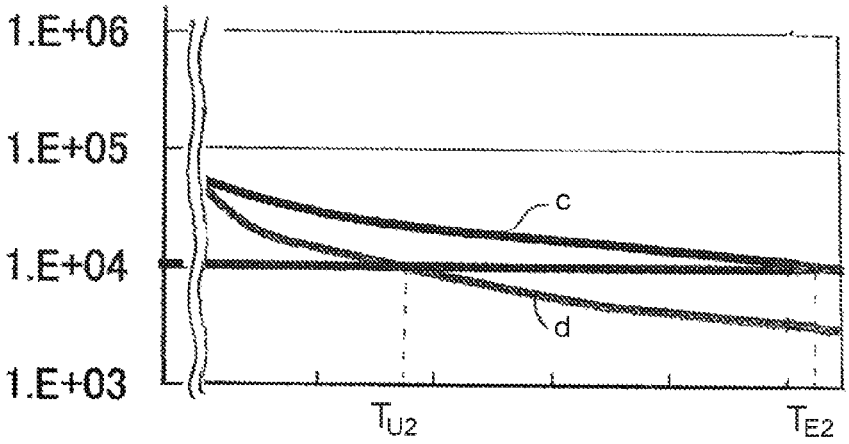
FIG. 4 is a graph illustrating an example of a storage modulus of a decolorable toner and a non-decolorable toner used in an exemplary embodiment.

In the image forming and erasing system of the embodiment, it was found that the temperature at which G' is $1.0\times10^4$ is an indicator of the high temperature offset properties of the toner, for both the decolorable toner and the non-decolorable toner. One example of the effect of changes in the storage modulus G' of the decolorable toner and the non-decolorable toner is illustrated in FIG. 4. In FIG. 4, a curve c represents the change in the storage modulus G' of the decolorable toner, and a curve d represents the change in the storage modulus G' of the non-decolorable toner, at different temperatures.

As shown in the curve c, the storage modulus G' of the decolorable toner is $1.0\times10^4$ at the temperature $T_{E2}$, and as shown in the curve d, the storage modulus G' of the non-decolorable toner is $1.0\times10^4$ or more temperature $T_{U2}$. In the embodiment, a difference ($|T_{E2}-T_{U2}|$) between the temperatures $T_{E2}$ and $T_{U2}$ is set to within 55° C.

If the difference ($|T_{E2}-T_{U2}|$) between the temperatures $T_{E2}$ and $T_{U2}$ is greater than 55° C., the difference of the fixing temperatures at a high temperature limit of fixing becomes too great. For example, if the temperature $T_{E2}$ is 55° C. or more higher than the temperature $T_{U2}$, a high temperature offset occurs when the non-decolorable toner printing image is decolored. In addition, time to change the fixing system from the decoloring temperature to the printing temperature is required, and thus, the image forming apparatus must sit idle between a printing and an erasing period, and efficiency of use of the apparatus is thereby reduced.

According to the embodiment, as between the decolorable toner and the non-decolorable toner, the difference of the temperature at which the storage modulus G' becomes $1.0\times10^4$ is set to be within 55° C., and thus, it became possible to avoid high temperature offset, and transfer of toner to the fixing apparatus, when an image is decolored.

As described above, if the printing speed in the image forming apparatus according to the embodiment is increased, it is possible to change the printing temperature required for the decolorable toner and the non-decolorable toner without requiring a pause in image processing by maintaining the difference of the temperature at which the storage modulus G' of the different toners becomes $1.0\times10^4$ is set to be within 55° C. In addition, in the image forming and decoloring system according to the embodiment, it is possible to decolor the decolorable image without incurring hot offset of the non-decolorable toner. Furthermore, in the image forming and decoloring system according to the embodiment, if decoloring and printing are performed at the on sequential sheets, it is possible to change the printing temperature between that of the decolorable toner and the non-decolorable toner without a pause in image processing, while avoiding the occurrence of the hot offset of the non-decolorable toner when the image is decolored.

Hereinafter, the decolorable toner and the non-decolorable toner used in the embodiment will be described.

The decolorable toner contains a colorant including a coloring compound and a color developing agent, and a binder resin. The colorant is preferably encapsulated, and if necessary, the decoloring agent may be contained.

The coloring compound is an electron donating compound capable of coloring by the color developing agent, and the representative example is a leuco dye. Examples of the coloring compound include diphenylmethanephthalides, phenylindolylphthalides, indolylphthalides, diphenylmethaneazaphthalides, phenylindolylazaphthalides, fluorns, styzylquinonles, diazarhodaminelactones.

Specifically, examples of the coloring compound include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis-(2-ethoxy-4-diethylaminophenyl)-4-azaphthalide, 3-(2-ethoxy-4-diethylaminopenyl)-3-(1-ethyl-2-methylindol-3-yl)-4-azaphthalide, 3-[2-ethoxy-4-(N-ethylamino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylamino)-6-diethylaminofluoran, 2-(N-methylamino)-6-(N-ethyl-N-p-tolylamino)fluoran, 1,3-dimethyl-6-diethylaminofluoran, 2-chloro-3-methyl-6-diethylaminofluoran, 2-amino-3-methyl-6-diethylaminofluoran, 2-anilino-3-methyl-6-di-n-butylaminofluoran, 2-xylidino-3-methyl-6-diethylaminofluoran, 1,2-benzo-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H) isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spizo[5H-(1)benzopyrano(2,3-d) pyrimidine-5,1'(3'H) isobenzofuran]-3'-one, 2-(di-n-butylamino)-8-(diethylamino)-4-methyl-, spiro[5H-(1) benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-ethylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Further, pyridine-based compounds, quinazoline-based compounds and bisquinazoline-based compounds may be also used as the coloring compound.

The above-described coloring compounds may be used alone, or two or more kinds may be used in combination.

The color developing agent which colors the coloring compound is an electron receptive compound which donates a proton to the leuco dye. Examples of the color developing agent include phenols, phenol metal salts, carboxylic acid metal salts, aromatic carboxylic acid, and aliphatic carboxylic acid having 2 to 5 carbon atoms, sulfonic acid, sulfonate, phosphoric acids, phosphoric acid metal salts, acidic phosphoric acid ester, acidic phosphoric acid ester metal salts, phosphorous acids, phosphorous acid metal salts, monophenols, polyphenols, 1,2,3-triazole, and the derivatives thereof. These compounds may be substituted with an alkyl group, an aryl group, an acyl group, an alkoxycarbonyl group, a carboxyl group, and the esters or an amide group thereof, and a halogen group. Bis- and tris-type phenols, phenol-aldehyde condensation resins, and the metal, salts thereof also may be used as the color developing agent.

Specifically, examples of the color developing agent include phenol, o-cresol, tertiary butyl catechol, nonylphenol, n-octyl phenol, n-dodecyl phenol, n-stearyl phenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof, for example, 2,3-dihydroxybenzoic acid, methyl 3,5-dihydroxybenzoate, resorcinol, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl) propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl) n-octane, 1,1-bis (4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl) ethylpropionate, 2,2-bis(4-hydroxyphenyl)-4-methylpentane, 2,2-bis(4-hydroxyphenyl) hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl], 2,3-benzenetriol 4,6-bis[(3,5-dimethyl-4-hydroxyphenyl) methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidynetrisphenol, 4,4'-(1-methylethylidene) bisphenol, and methylenetris-p-cresol.

The above-described color developing agent may be used alone, or two or more kinds thereof may be used in combination.

In the three-component system of the coloring compound, the color developing agent, and the decoloring agent, the decoloring agent inhibits a coloring reaction by the leuco dye and the color developing agent by application of heat, and thus makes the resulting material, and the image printed therewith, decolored. Any compound that may achieve this may be used as the decoloring agent.

The decoloring agent having a coloring and decoloring mechanism using a temperature hysteresis is excellent in terms of an instantaneous decoloring ability. Such decoloring agents are disclosed in JP-A-60-264285, JP-A-2005-1369, and JP-A-2008-280523. When a colored mixture including the three-components of the coloring compound, the color developing agent, and the decoloring agent is heated to a specific decoloring temperature or higher, it will be decolored. Even when the decolored mixture is cooled to the decoloring temperature or lower, the decoloring state is maintained. When the temperature is further lowered to a low enough temperature, it will cause a reversible coloring and decoloring reaction in which a coloring reaction by the leuco dye and the color developing agent is recovered again. This is known as the specific color recovering temperature, and the state of the image is returned to a visible, or "colored" state.

In the embodiment, the decoloring temperature is preferably higher than room temperature, and the recovering temperature is preferably lower than room temperature. A decoloring agent which provides the above-described conditions may be appropriately selected and used. Examples of the decoloring agent capable of causing the temperature hysteresis include alcohols, esters, ketones, ethers, and acid amides.

As the decoloring agent, the esters are particularly preferable. Specifically, examples of the ester include carboxylic acid ester containing a substituted aromatic ring, ester obtained from a reaction of carboxylic acid containing an unsubstituted aromatic ring and aliphatic alcohol, carboxylic acid ester containing a cyclohexyl group in a molecule, ester obtained from a reaction of fatty acid and an unsubstituted aromatic alcohol or phenol, ester obtained from a reaction of fatty acid and branched aliphatic alcohol, ester obtained from a reaction of dicarboxylic acid and aromatic alcohol or branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used in a mixture of two or more kinds.

An encapsulating agent (shell material) forming a shell of the colorant, which is not particularly limited, may be appropriately selected and used. As a method for forming an encapsulated colorant, for example, an interfacial polymerization method, a co-acervation method, an in situ polymerization method, a drying method in liquid, and a curing coating method in liquid are exemplified.

In particular, the colorant is preferably encapsulated by the in-situ method using a melamine resin as a shell component, and the interfacial polymerization method using a urethane resin as the shell component.

In the in-Situ method, first, colorant components (coloring compound, color developing agent, and decoloring agent which is added if necessary) are dissolved and mixed, and the mixture is emulsified in a water-soluble polymer or an aqueous surfactant solution. Thereafter, melamine formaldehyde prepolymer aqueous solution is added, and by thermal polymerization, it is possible to encapsulate the colorant.

In the interfacial polymerization, colorant components and a polyvalent isocyanate prepolymer are dissolved and mixed, and the mixture is emulsified in a water-soluble polymer or an aqueous surfactant solution. Thereafter, polyvalent base such as diamine or diol is added, and by thermal polymerization, it is possible to encapsulate.

The volume average diameter D50 of the encapsulated colorant is preferably 0.5 μm to 3.5 μm. When the volume average diameter D50 is outside the range of 0.5 μm to 3.5 μm, it was experimentally confirmed that the incorporation of the colorant is deteriorated. The mechanism by which the incorporation of the colorant with a smaller diameter is deteriorated is not exactly known. When using the encapsulated colorant, the incorporation into the binder resin is deteriorated if the particle diameter of the colorant is less than a certain particle diameter, and the generated amount of fine powder is increased.

Moreover, the volume average diameter D50 of the colorant, for example, may be obtained by a laser diffraction-type particle size distribution analyzer.

In addition, by maintaining the encapsulated colorant in cold conditions, at or below the coloring (recoloring) temperature, the coloring compound and the color developing agent react and the compound becomes colored. A coloring temperature is set appropriately in accordance with the type of the specific coloring compound and color developing agent, and for example, the temperature is −20° C. to −30° C.

Examples of the binder resin include styrene-based resins such as polystyrene, a styrene-butadiene copolymer, and a styrene-acrylic copolymer, ethylene-based resins such as polyethylene, a polyethylene-vinyl acetate copolymer, a polyethylene-norbornene copolymer, and a polyethylene-vinyl alcohol copolymer, a polyester resin, a acryl-based resin, a phenol-based resin, an epoxy-based resin, an allyl phthalate-based resin, a polyamide-based resin, and a maleic acid-based resin. The binder resin preferably has an acid value of 1 or more.

The above-described binder resins may be used alone, or two or more kinds may be used in combination. The binder resin may be used with core particles and shell particles.

The toner of the embodiment may further contain the following components.

Release Agent

Examples of the release agent include aliphatic hydrocarbon-based waxes such as low molecular weight polyethylene, low molecular weight polypropylene, a polyolefin copolymer, a polyolefin wax, microcrystalline wax, a paraffin wax, and a Fischer-Tropsch wax, oxides of aliphatic hydrocarbon-based waxes such as a polyethylene oxide wax, block copolymers thereof, vegetable-based waxes such as a candelilla wax, a carnauba wax, a japanese wax, a jojoba wax, and a rice wax, animal-based waxes such as a bees wax, lanolin, and spermaceti, mineral-based waxes such as ozocerite, ceresin, and petrolatum, waxes such as a montanic acid ester wax and a castor wax in which the main component is fatty acid ester, and waxes such as a deoxidized carnauba wax in which fatty acid ester is partly or entirely deoxidized.

Furthermore, saturated linear fatty acids such as palmitic acid, stearic acid, montanic acid, and long chain alkyl carboxylic acids with a long chain alkyl group, unsaturated fatty acids such as brassidic acid, eleostearic acid, and parinaric acid, saturated alcohols such as stearyl alcohol, eicosyl alcohol, behenyl alcohol, carnaubyl alcohol, ceryl alcohol, melissyl alcohol, or long-chain alkyl alcohols with a long chain alkyl group, polyvalent alcohols such as sorbitol, fatty acid amides such as linoleic acid amide, oleic acid amide, and lauric acid amide, saturated fatty acid bisamides such as methylene bisstearic acid amide, ethylene biscaprin acid amide, ethylene bislauric acid amide, or hexamethylene bisstearic acid amide, unsaturated fatty acid amides such as ethylene bisoleic acid amide, hexamethylene bisoleic acid amide, N,N'-dioleyl adipic acid amide, or N,N'-dioleyl sebacic acid amide, aromatic bisamides such as m-xylene bisstearic acid amide, or N,N'-distearylisophthalic acid amide, fatty acid metal salts such as calcium stearate, calcium laurate, zinc stearate, or magnesium stearate (generally called metal soap), wax grafted using a vinyl monomer such as styrene or acrylic acid to aliphatic hydrocarbon wax, partially esterified material of fatty acid and polyvalent alcohol such as monoglyceride behenate, and a methyl ester compound with a hydroxyl group obtained by hydrogenation of vegetable oil may be exemplified.

Charge Control Agent (CCA)

A charge control agent controls a triboelectric charging charge amount of the toner. Examples of the charge control agent include positive electrostatic charge control agents such as nigrosin dyes, quaternary ammonium compounds, and polyamine-based resins, and metal-containing azo compounds. Complexes or complex salts of iron, cobalt, or chromium, or mixtures thereof, and metal-containing salicylic acid derivative compound including these metals may also be used. Negative electrostatic charge control agents such as complexes or complex salts of zirconium, zinc, chromium, or boron, or mixtures thereof may also be used as the charge control agent in the embodiment.

Surfactant

Examples of a surfactant include anionic surfactants such as sulfuric ester salts, sulfonates, phosphate esters, and soaps, cationic surfactants such as amine salts and quaternary ammonium salts, and nonionic surfactants such as polyethylene glycols, alkylphenol ethylene oxide adducts, and polyhydric alcohols.

Coagulant

The coagulant is used in an aggregation step. Examples of the coagulant include metal salts such as sodium chloride, calcium chloride, calcium nitrate, barium chloride, magnesium chloride, zinc chloride, magnesium sulfate, aluminum chloride, aluminum sulfate, and aluminum potassium sulfate; inorganic metal salt polymers such as poly aluminum chloride, poly aluminum hydroxide, and calcium polysulfide; polymer coagulants such as polymethacrylic acid ester, polyacrylic acid ester, polyacrylamide, and acrylamide sodium acrylate copolymer; coagulating agents such as polyamine, polydiallyl ammonium halide, melanin formaldehyde condensate, and dicyandiamide; alcohols such as methanol, ethanol, 1-propanol, 2-propanol, 2-methyl-2-propanol, 2-methoxy ethanol, 2-ethoxyethanol, and 2-butoxyethanol; organic solvents such as acetonitrile and 1,4-dioxane; inorganic acids such as hydrochloric acid and nitric acid; and organic acids such as formic acid and acetic acid.

Neutralizer

As a neutralizer, inorganic bases or amine compounds may be used. Examples of the inorganic bases include sodium hydroxide, potassium hydroxide, and the like. Examples of the amine compound include dimethylamine, trimethylamine, monoethylamine, diethylamine, triethylamine, propylamine, isopropyl amine, dipropylamine, butylamine, isobutyl amine, sec-butylamine, monoethanol amine, diethanol amine, triethanol amine, triisopropanol amine, isopropanol amine, dimethylethanol amine, diethylethanol amine, N-butyldiethanol amine, N,N-dimethyl-1,3-diaminopropane, and N,N-diethyl-1,3-diaminopropane.

The non-decolorable toner is not particularly limited, and a toner containing non-decolorable toner particles known in the related art including a colorant and a binder resin, and if necessary, an additive added to a toner particle surface may be used. Moreover, in a two-component developer, the toner and a carrier are mixed.

In the non-decolorable toner, a colorant which is different from the colorant in the decolorable toner is included, and examples of the colorant include carbon black, organic or inorganic pigments, and organic or inorganic dyes. Specifically, examples of the carbon black include acetylene black, furnace black, thermal black, channel black, and ketjen black.

Examples of the yellow pigment include C. I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185, and C. I. and Vat Yellow 1, 3, and 20. These may be used alone or in a mixture thereof.

Examples of the magenta pigment include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238, C. I. Pigment Violet 19, and C. I. Vat Red 1, 2, 10, 13, 15, 23, 29, and 35. These may be used alone or in a mixture thereof.

Examples of the cyan pigment include C. I. Pigment Blue 2, 3, 15, 16, and 17, C. I. Vat Blue 6, and C. I. Acid Blue 45. These may be used alone or in a mixture thereof.

As the binder resin, for example, polyester-based resins and styrene-acryl-based resins may be used. By using a binder resin which is different from the binder resin in the decolorable toner, it is possible to set the viscoelastic property within the desired range. In order to set the viscoelastic property within the desired range, it is possible to employ a binder resin different from the binder resin in the decolorable toner in view of toner manufacturing conditions, and the influence of the release agent and the colorant. In addition, it is possible to add a wax as a fixation assistant agent, and the charge control agent (CCA) to the above-described toner particles. Among such a non-decolorable toner, considering the fixing temperature and the decoloring temperature of the decolorable toner accommodated in the developing device 14*a*, a non-decolorable toner with a fixing temperature at about the same temperature as the decolorable toner is preferably used.

When manufacturing the toner, if the binder resin with a low melting point is used, it is possible to secure a high temperature offset temperature by adding the release agent.

In a pulverized toner, pulverization is performed at the interfaces of the binder resin, the release agent, and the colorant. Since the release agent is easily exposed at the surface of the toner, filming occurs, and therefore, addition of the release agent above a certain level is not easy. On the other hand, in a wet method such as an emulsion aggregation method, it is possible to manufacture a toner with a core shell structure, and it is possible to suppress the release agent exposed on the surface. For this reason, even when a larger amount of the release agent than that in a pulverization method is added, filming does not occur.

Considering the particle diameter and properties of the colorant, the decolorable toner is preferably prepared by the wet method. In contrast, the non-decolorable toner may be prepared by any method of the pulverization method and the wet method.

Moreover, if the method is different from the pulverization method and the wet method, even when using the same raw materials, the same fixing characteristic may not always be obtained due to the effects of hydrolysis of the binder resin, arrangement of the release agent, circularity, and the like. The added amount of the release agent also may be arbitrarily selected.

In manufacturing the toner, a mechanical shearing apparatus may be used. Examples of the mechanical shearing apparatus include medialess stirrers such as ULTRA-TURRAX (manufactured by IKA Japan K.K.), TK Autohomomixer (manufactured by PRIMIX Corporation), TK pipeline Homo Mixer (manufactured by PRIMIX Corporation), TK Filmix (manufactured by PRIMIX Corporation), CLEARMIX (manufactured by M Technique Co., Ltd.), CLEAR SS5 (manufactured by M Technique Co., Ltd.), Cavitron (manufactured by EUROTEC LTD.), and Fine Flow Mill (manufactured by Pacific Machinery & Engineering Co., Ltd.), media stirrers such as Viscomill (manufactured by AIMEX CO., Ltd.), Apex Mill (manufactured by KOTOBUKI INDUSTRIES CO., LTD.), Star Mill (manufactured by Ashizawa Finetech Ltd.), DCP SuperFlow (manufactured by Nippon Eirich Co., Ltd.), MP Mill (manufactured by Inoue MFG., INC.), Spike Mill (manufactured by Inoue MFG., INC.), Mighty Mill (manufactured by inoue MFG., INC.), and SC Mill (manufactured by Mitsui Mining Co., Ltd.), and high-pressure impact type dispersers such as Ultimizer (manufactured by SUGINO MACHINE LIMITED), Nanomizer (manufactured by Yoshida Kikai Co., Ltd.), and NANO 3000 (manufactured by Beryu corp.)

The particle diameter of the non-decolorable toner may be different from the particle diameter of the decolorable toner. In the non-decolorable toner, the particle diameter is a particle diameter of the toner particles after pulverization of the toner and in the non-decolorable toner, and the particle diameter is a particle diameter of the toner composition aggregate. The particle diameter of the toner, for example, may be measured using a Multisizer 3 (manufactured by Beckman Coulter Inc.: aperture diameter 100 μm).

A release agent endothermic peak of the decolorable toner and the non-decolorable toner may be obtained by differential scanning calorimetry (DSC). The release agent endothermic peak of the decolorable toner is preferably the release agent endothermic peak of the non-decolorable toner or greater. In this case, an effect in which the low temperature fixing property of the toner is improved is obtained.

Hereinafter, specific examples using the combination of the decolorable toner and the non-decolorable toner are shown.

Preparation of Resin Fine Particle Dispersion Material 1

30 parts by mass of a polyester resin ($T_g$ 58° C.), 1 part by mass of sodium dodecylbenzene sulfonate (NEOPELEX G15, manufactured by Kao Corporation), and 69 parts by mass of ion-exchange water were mixed to prepare a dispersion, and a pH of the dispersion was adjusted to pH 12 with potassium hydroxide. The obtained dispersion was accommodated in a high pressure homogenizer NANO 3000 (manufactured by Beryu corp.), treatment of 150 MPa at 150° C. was performed, and a resin fine particle dispersion material 1 was obtained. The dispersion diameter of the obtained dispersion material was measured by SALD 7000 manufactured by Shimadzu Corporation, and, a sharp particle diameter distribution with a volume average particle diameter of 0.23 m and a standard deviation of 0.15 was obtained.

Preparation of Resin Fine Particle Dispersion Material 2

30 parts by mass of a polyester resin ($T_g$ 62° C.), 1 part by mass of sodium dodecylbenzene sulfonate (NEOPELEX G15, manufactured by Kao Corporation), and 69 parts by mass of ion-exchange water were mixed to prepare a dispersion, and a pH of the dispersion was adjusted to pH 12 with potassium hydroxide. The obtained dispersion was accommodated in a high pressure homogenizer NANO 3000 (manufactured by Beryu corp.), treatment of 150 MPa at 150° C. was performed, and a resin fine particle dispersion material 2 was obtained. The dispersion diameter of the obtained dispersion material was measured by SALD 7000 manufactured by Shimadzu Corporation, and, a sharp particle diameter distribution with a volume average particle diameter of 0.18 m and a standard deviation of 0.1.4 was obtained.

Preparation of Resin Fine Particle Dispersion Material 3

30 parts by mass of a polyester resin ($T_g$ 66° C.), 1 part by mass of sodium dodecylbenzene sulfonate (NEOPELEX G15, manufactured by Kao Corporation), and 69 parts by mass of ion-exchange water were mixed to prepare a dispersion, and a pH of the dispersion was adjusted to pH 12 with potassium hydroxide. The obtained dispersion was accommodated in a high pressure homogenizer NANO 3000 (manufactured by Beryu corp.), treatment of 150 MPa at 150° C. was performed, and a resin fine particle dispersion material 3 was obtained. The dispersion diameter of the obtained dispersion material was measured by a SALD 7000 manufactured by Shimadzu Corporation, and a sharp particle diameter distribution with a volume average particle diameter of 0.25 μm and a standard deviation of 0.16 was obtained.

Preparation of Colorant Dispersion Material 2 parts by mass of 3-(4-diethylamino-2-hexyloxyphenyl)-3-(1-ethyl-2-methylindol-3-yl)-4-azaphthalide as the leuco dye, 4 parts by mass of 1,1-bis(4'-hydroxyphenyl)hexafluoropropane as the color developing agent and 4 parts by mass of 1,1-bis(4'-hydroxyphenyl)n-decane, and 50 parts by mass of caprylic acid-4-benzyloxyphenylethyl as the decolorable agent were homogeneously dissolved by heating.

30 parts by mass of an aromatic polyvalent isocyanate prepolymer and 40 parts by mass of ethyl acetate were added to the mixture as an encapsulating agent. The obtained solution was emulsified and dispersed in 300 parts by mass of 8% polyvinyl alcohol aqueous solution, and the resultant product was stirred for about 1 hour at 70° C. Thereafter, 2.5 parts of water-soluble aliphatic modified amine were added as a reactant, the mixture was further stirred for 6 hours, and colorless capsule particles were obtained.

The capsule particle dispersion material was accommodated in a freezer (−30° C.) to result in coloring thereof, and by then adding ion-exchange water, a colorant dispersion material of 27% by mass was obtained. As a result of the measurement using the SALD 7000 manufactured by Shimadzu Corporation, it was confirmed that the obtained volume average particle diameter of the colorant dispersion material was 3.3 μm.

Preparation of Release Agent Dispersion Material 20 parts by mass of the carnauba wax, 1 part by mass of dipotassium alkenyl sulfosuccinate (LATEMUL ASK, manufactured by Kao Corporation), and 79 parts by mass of ion-exchange water were mixed to prepare a dispersion. The obtained dispersion was accommodated in a rotor and stator type homogenizer CLEARMIX 2.2S (manufactured by M Technique Co., Ltd), and by raising the temperature to 100° C. while stirring at 1000 rpm, a release agent dispersion material was prepared. The dispersion diameter of the obtained dispersion material was measured by the SALD 7000 manufactured by Shimadzu Corporation, and the volume average particle diameter was 0.5 μm.

Decolorable Toner 1

Using the colorant dispersion material, the release agent dispersion material, and the resin fine particle dispersion material 1, a decolorable toner 1 was prepared.

First, 42 parts by mass of the colorant dispersion material and 63 parts by mass of ion-exchange water were mixed, 50 parts by mass of a 30% ammonium sulfate solution were added to the mixture while stirring, and the resultant product was held for 1 hour. Thereafter, 14 parts by mass of the release agent dispersion material were added, and by raising the temperature to 30° C., an aggregate dispersion with a volume average particle diameter of 6.2 μm was prepared. Here, 300 parts by mass of the resin fine particle dispersion material 1 which was adjusted to have a solid content concentration of 15% were slowly added over 10 hours, and a toner composition aggregate dispersion was thus obtained.

As a result of the measurement by a Multisizer 3 (manufactured by Beckman Coulter Inc.: aperture diameter 100 μm), the volume average particle diameter of the toner composition aggregate was 9.3 μm (Cv value of 16.5).

Furthermore, 5 parts by mass of a polycarboxylic acid-based surfactant (POIZ 520, manufactured by Kao Corporation) was added to the toner composition aggregate dispersion as a surfactant, the mixture was heated to 60° C., and by being left to stand, a toner dispersion was prepared. The toner dispersion was repeatedly filtered and washed with ion-exchange water, and the toner dispersion was washed until the conductivity of the filtrate became 50 μS/cm. Thereafter, the toner dispersion was dried with a vacuum dryer until a water content became 1.0% by mass or less, and dried toner particles were obtained.

After drying, as an additive, 2 parts by mass of hydrophobic silica and 0.5 parts by mass of titanium oxide were attached to the toner particle surface, and a decolorable toner 1 was thus obtained.

Decolorable Toner 2

Using the colorant dispersion material, the release agent dispersion material, and the resin fine particle dispersion material 2, a decolorable toner 2 was prepared.

First, 42 parts by mass of the colorant dispersion material and 63 parts by mass of ion-exchange water were mixed, 50 parts by mass of a 30% ammonium sulfate solution were added to the mixture while stirring, and the resultant product was held for 1 hour. Thereafter, 14 parts by mass of the release agent dispersion material were added, and by raising the temperature to 30° C., an aggregate dispersion with the volume average particle diameter of 6.2 m was prepared. Here, 300 parts by mass of the resin fine particle dispersion material 2 which was adjusted to have a solid content concentration of 15% were slowly added over 10 hours, and a toner composition aggregate dispersion was obtained.

As a result of the measurement by a Multisizer 3 (manufactured by Beckman Coulter Inc.: aperture diameter 100 μm), the volume average particle diameter of the toner composition aggregate was 9.6 m (Cv value of 16.5).

Furthermore, 5 parts by mass of a polycarboxylic acid-based surfactant (POIZ 520, manufactured by Kao Corporation) were added to the toner composition aggregate dispersion as a surfactant, the mixture was heated to 60° C., and by being left to stand, a toner dispersion was prepared. The toner dispersion was repeatedly filtered and washed with ion-exchange water, and the toner dispersion was washed until the conductivity of the filtrate became 50 μS/cm. Thereafter, the toner dispersion was dried with a vacuum dryer until the water content became 1.0% by mass or less, and dried toner particles were obtained.

After drying, as an additive, 2 parts by mass of hydrophobic silica and 0.5 parts by mass of titanium oxide were attached to the toner particle surface, and a decolorable toner 2 was obtained.

Decolorable Toner 3

Using the colorant dispersion material, the release agent dispersion material, and the resin fine particle dispersion material 3, a decolorable toner 3 was prepared.

First, 42 parts by mass of the colorant dispersion material and 63 parts by mass of ion-exchange water were mixed, 50 parts by mass of a 30% ammonium sulfate solution were added to the mixture while stirring, and the resultant product was held for 1 hour. Thereafter, 14 parts by mass of the release agent dispersion material were added, and by raising the temperature to 30° C., an aggregate dispersion with the volume average particle diameter of 6.2 μm was prepared. Here, 300 parts by mass of the resin fine particle dispersion material 3 which was adjusted to have a solid content concentration of 15% was slowly added over 10 hours, and a toner composition aggregate dispersion was obtained.

As a result of the measurement by a Multisizer 3 (manufactured by Beckman Coulter Inc.: aperture diameter 100 μm), the volume average particle diameter of the toner composition aggregate was 9.6 μm (Cv value of 16.5).

Furthermore, 5 parts by mass of a polycarboxylic acid-based surfactant (POIZ 520, manufactured by Kao Corporation) were added to the toner composition aggregate dispersion as a surfactant, the mixture was heated to 60° C., and by being left to stand, a toner dispersion was prepared. The toner dispersion was repeatedly filtered and washed with ion-exchange water, and the toner dispersion was washed until the conductivity of the filtrate became 50 μS/cm. Thereafter, the toner dispersion was dried with a vacuum dryer until the water content became 1.0% by mass or less, and dried toner particles were obtained.

After drying, as an additive, 2 parts by mass of hydrophobic silica and 0.5 parts by mass of titanium oxide were attached to the toner particle surface, and a decolorable toner 3 was obtained.

Non-Decolorable Toner 1

90 parts by mass of a polyester resin ($T_g$ 58° C.), 5 parts by mass of the cyan pigment (copper phthalocyanine) as the colorant, 4 parts by mass of an ester wax, and 1 part by mass of a zirconia metallic complex as the charge control agent were mixed. The obtained mixture was melt and kneaded using a twin screw kneader of which the temperature was set at 120° C., and a kneaded material was prepared.

After the obtained kneaded material was coarsely pulverized using a feather mill, the pulverized material was pulverized using a jet mill and classified using a rotor-type classifier. As an additive, 2.5 parts by mass of hydrophobic silica and 0.8 parts by mass of titanium oxide were attached to the toner particle surface, and a non-decolorable toner 1 was obtained.

Non-Decolorable Toner 2

90 parts by mass of a polyester resin ($T_g$ 55° C.), 5 parts by mass of the cyan pigment (copper phthalocyanine) as the colorant, 4 parts by mass of an ester wax, and 1 part by mass of a zirconia metallic complex as the charge control agent were mixed. The obtained mixture was melt and kneaded using a twin screw kneader of which the temperature was set at 120° C., and a kneaded material was prepared.

After the obtained kneaded material was coarsely pulverized using a feather mill, the pulverized material was pulverized using a jet mill and classified using a rotor-type classifier. As an additive, 2.5 parts by mass of hydrophobic silica and 0.8 parts by mass of titanium oxide were attached to the toner particle surface, and a non-decolorable toner 2 was obtained.

The viscoelastic property of the decolorable toners 1 to 3 and the non-decolorable toners 1 and 2 obtained as described above was measured under the conditions below.

Each toner was compression-molded, and pellets with a diameter of 10 mm and a height of 2 mm were prepared. A viscoelastic property was measured using a viscoelasticity measurement apparatus (AR-G2, manufactured by TA Instruments), a measurement frequency was set to 6.28 rad/sec, a measurement was performed every minute at a temperature rise rate of 3° C./min from 40° C. to 250° C. using a parallel plate with a diameter of 8 mm as a measuring tool, and the storage modulus G', the loss modulus G", and the loss tangent tan δ (loss modulus G"/storage modulus G') were obtained.

In the decolorable toners 1 to 3, the temperature $T_{E2}$ at which G' becomes $1\times10^4$ and the first peak temperature $T_{E1}$ of tan δ together with the glass transition temperature $T_g$ of each toner are shown in the following Table 1.

TABLE 1

| Decolorable toner | $T_g$ (° C.) | $T_{E2}$ (° C.) | $T_{E1}$ (° C.) |
|---|---|---|---|
| 1 | 58 | 150 | 66 |
| 2 | 62 | 180 | 72 |
| 3 | 66 | 220 | 78 |

In the non-decolorable toners 1 and 2, the temperature $T_{U2}$ at which G' becomes $1\times10^4$, the first peak temperature $T_{U1}$ of tan δ, and the glass transition temperature $T_g$ of each toner are shown in the following Table 2.

TABLE 2

| Non-decolorable toner | $T_g$ (° C.) | $T_{U2}$ (° C.) | $T_{U1}$ (° C.) |
|---|---|---|---|
| 1 | 58 | 160 | 55 |
| 2 | 55 | 130 | 49 |

Using the decolorable toner and the non-decolorable toner in combination, an image was formed by a remodeled MFP e-studio 3555C manufactured by Toshiba Tec Corp., and the offset property was evaluated. The combination of the decolorable toner and the non-decolorable toner is as shown in Table 3. In Table 3, the difference ($|T_{E1}-T_{U1}|$) between the temperatures at which the first peak of tan δ appears and the difference ($|T_{E2}-T_{U2}|$) between the temperatures at which G' becomes $1.0\times10^4$ in each combination are shown.

TABLE 3

| | De-colorable toner | Non-de-colorable toner | $\|T_{E1} - T_{U1}\|$ | $\|T_{E2} - T_{U2}\|$ |
|---|---|---|---|---|
| Example 1 | 1 | 1 | 11 | 10 |
| Example 2 | 2 | 1 | 17 | 20 |
| Comparative Example 1 | 2 | 2 | 23 | 50 |
| Comparative Example 2 | 3 | 1 | 23 | 60 |

Example 2

A low temperature offset and a high temperature offset were evaluated by the following methods, respectively.

Evaluation of Low Temperature Offset

The attached amount on sheet of each toner was adjusted as follows.

Decolorable toner: 0.6 mg/cm$^2$

Non-decolorable toner: 1.0 mg/cm$^2$

An unfixed tip solid image was printed on sheet, and the image was passed through the fixing portion which was set to a predetermined temperature. The temperature of the fixing portion, for example, may be changed in a range of 70° C. to 95° C. Here, a tip solid image refers to a solid band of 20 mm×250 mm after a margin of 10 mm from an image tip. After the image was fixed through the fixing portion, the lowest temperatures ($T_{cos}$) for the decolorable toner and for the non-decolorable toner are respectively determined as a temperature at which the following conditions are satisfied.

1. Fixing rate of a toner image after passing through the fixing portion becomes 75% or greater.
2. ΔE of a blank sheet portion, which is formed on the sheet periodically based on rotating period the fixing portion rotation if the fixing is performed in an adequate condition, becomes 0.4 or less.

And the respective temperature are defined as $T_{cos}$(E) and $T_{cos}$(U), respectively. If a difference $\Delta T_{cos}$ between $T_{cos}$(E) and $T_{cos}$(U) is less than 15° C., it is defined as "OK", and if the difference is equal to or greater than 15° C., it is defined as NG (no good).

The fixing ratio is determined as the ratio of image density of a printed image and an image density of the printed image added some mechanical rubbing force. Namely, at first the image density of the printed image is measured. Thereafter, this image portion was subjected to a rubbing treatment using a 100% cotton pad and then measured again with respect to the density of the image, thereby calculating and determining the fixing ratio according to the following formula.

fixing ratio=(density of image after rubbing/density of image before rubbing).

As the $\Delta T_{cos}$ is becomes smaller, fixable temperatures of the decolorable toner and the non-decolorable toner become closer. If the $\Delta T_{cos}$ is less than 15° C., the efficiency of printing is not impaired, and it is possible to fix the decolorable toner and the non-decolorable toner under the same temperature conditions.

Evaluation of High Temperature Offset

The attached amount on sheet of each toner was adjusted as follows.

Decolorable toner: 0.6 mg/cm$^2$

Non-decolorable toner: 1.0 mg/cm$^2$

An unfixed tip solid image was printed on sheet, and the image was passed through rotating fixing portion which was set to a predetermined temperature. The temperature of the fixing portion, for example, may be changed in a range of 110° C. to 180° C.

The highest temperatures for the decolorable toner and for the non-decolorable toner are respectively determined with the same method to determine the lowest temperatures.

In the decolorable toner, after a print sample is recolored by freezing, a temperature $T_{HOS}$(E) at which the offset does not occur is obtained in the same manner. If a difference $\Delta T_{HOS}$ between $T_{HOS}$(E) and $T_{HOS}$ (U) is less than 35° C., it is defined as "OK", and if the difference is equal to or greater than 35° C., it is defined as NG.

As the $\Delta T_{HOS}$ becomes smaller, temperatures at which the hot offset of the decolorable toner and the non-decolorable toner does not occur become closer. If the $\Delta T_{HOS}$ is less than 35° C., the hot offset of the non-decolorable toner does not occur when erasing the color of the decolorable toner.

The evaluation results of the offset in Examples 1 and 2, and Comparative Examples 1 and 2 are summarized in the following Table 4.

TABLE 4

| | Offset | |
|---|---|---|
| | Low temperature | High temperature |
| Example 1 | OK | OK |
| Example 2 | OK | OK |
| Comparative Example 1 | NG | OK |
| Comparative Example 2 | NG | NG |

As shown in the above Table 4, in Examples 1 and 2, the low temperature offset evaluation is OK, and it is found that there is no problem. As shown in the above Table 3, in combination of the decolorable toner and the non-decolorable toner in Example 1, the difference ($|T_{E1}-T_{U1}|$) between the temperatures at which the first peak of tan δ appears is 11° C., and in combination of the decolorable toner and the non-decolorable toner in Example 2, the difference ($|T_{E1}-T_{U1}|$) between the temperatures at which the first peak of tan δ appears is 17° C. When the difference (($|T_{E1}-T_{U1}|$) between the temperatures at which the first peak of tan δ appears is within 20° C., it was confirmed that the low temperature offset is OK.

In Examples 1 and 2, the high temperature offset evaluation is also OK, and there is no problem using the toners. As shown in the above Table 3, in combination of the decolorable toner and the non-decolorable toner in Example 1, the difference (($|T_{E2}-T_{U2}|$) between the temperatures at which G' becomes $1.0\times10^4$ is 10° C., and in combination of the decolorable toner and the non-decolorable toner in Example 2, the difference ($(|T_{E2}-T_{U2}|)$ between the temperatures at which G' becomes $1.0\times10^4$ is 20° C. When the difference ($(|T_{E2}-T_{U2}|)$ between the temperatures at which G' becomes $1.0\times10^4$ is within 35° C., it was confirmed that the evaluation of the high temperature offset is OK.

In Comparative Example 1, the low temperature offset evaluation is NG. As shown in the above Table 3, in combination of the decolorable toner and the non-decolorable toner in Comparative Example 1, the difference ($(|T_{E1}-T_{U1}|)$ between the temperatures at which the first peak of tan δ appears is 23° C., and the evaluation is NG because the difference is greater than 20° C.

In Comparative Example 2, both the low temperature offset evaluation and the high temperature offset evaluation are NG. As shown in the above Table 3, in combination of the decolorable toner and the non-decolorable toner in Comparative Example 2, the difference ($|T_{E1}-T_{U1}|$) between the temperatures at which the first peak of tan δ appears is 23° C., and the difference is greater than 20° C. In addition, the difference ($(|T_{E2}-T_{U2}|)$ between the temperatures at which G' becomes $1.0\times10^4$ is 60° C., and the difference is greater than 55° C.

As described above, if the printing speed in the image forming apparatus according to the embodiment is changed, it is possible that the resulting printing temperature of the decolorable toner and the non-decolorable toner can be used without requiring pausing of the system to allow the temperature of the fixing portion to cool. In addition, in the image forming and decoloring system according to the embodiment, it is possible to decolor the decolorable image without occurrence of the hot offset of the non-decolorable toner. Furthermore, in the image forming and decoloring system according to the embodiment, if decoloring and printing are performed at the same time, it is possible to change the printing temperatures between the decolorable toner and the non-decolorable toner without pausing, and it is possible to avoid the occurrence of the hot offset of the non-decolorable toner when decoloring.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus which forms a decolorable image and an non-decolorable image by fixing a toner image including a decolorable toner and a toner image including a non-decolorable toner on a medium, wherein:

the decolorable toner has a first peak of a loss tangent tan δ at a temperature $T_{E1}$ and has a storage modulus of $1.0\times10^4$ at a temperature $T_{E2}$, the non-decolorable toner has a first peak of the loss tangent tan 8 at a temperature $T_{U1}$ and has the storage modulus of $1.0\times10^4$ at $T_{U2}$, a difference between the temperature $T_{E1}$ and the temperature $T_{U1}$ is within 20° C., and a difference between the temperature $T_{E2}$ and the temperature $T_{U2}$ is within 55° C.

2. The apparatus according to claim 1, wherein the decolorable toner contains a first resin and a first colorant, and the non-decolorable toner contains a second resin different from the first resin and a second colorant different from the first colorant.

3. The apparatus according to claim 1, wherein the decolorable toner is manufactured by a first method, and the non-decolorable toner is manufactured by a second method different from the first method.

4. The apparatus according to claim 1, wherein the decolorable toner comprises particles with a first particle diameter, and the non-decolorable toner comprises particles with a second particle diameter different from the first particle diameter.

5. The apparatus according to claim 1, wherein the decolorable toner includes a colorant, and the average diameter of the colorant is in the range of 0.5 μm to 3.5 μm.

6. The apparatus according to claim 1, further comprising a heated nip, wherein the toners are fixed on a sheet, and the heated nip temperature is maintainable at a fixing temperature of the toners and the decoloring temperature of the decolorable toner.

7. The apparatus of claim 6, further comprising: a transport path configured to move sheets within the apparatus from a first location to the heated nip, wherein the belt moves sheets at a constant speed in the direction of the nip when a sheet having a non-colorable toner thereon is fixed in the nip and an immediately subsequent sheet having a fixed decolorable toner image thereon is decolored in the nip.

8. The apparatus according to claim 1, wherein the apparatus fixes the toner image including the decolorable toner and the toner image including the non-decolorable toner at temperatures equal to or less than 55° C.

9. The apparatus according to claim 1, wherein the apparatus fixes the toner image including the decolorable toner and the toner image including the non-decolorable toner at temperatures equal to or greater than 35° C.

10. An image forming and decoloring system which forms an decolorable first image and an non-decolorable second image by fixing a toner image including a decolorable toner and a toner image including a non-decolorable toner on a medium, and erases the first image on the medium by heating, wherein:

the decolorable toner has a first peak of a loss tangent tan δ at a temperature $T_{E1}$ and a storage modulus G' of $1\times10^4$ at a temperature $T_{E2}$, the non-decolorable toner has a first peak of the loss tangent tan δ at a temperature $T_{U1}$ and the storage modulus G' of $1\times10^4$ at a temperature $T_{U2}$, a difference between the temperature $T_{E1}$ and the temperature $T_{U1}$ is within 20° C., and a difference between the temperature $T_{E2}$ and the temperature $T_{U2}$ is within 55° C.

11. The system according to claim 10, wherein the decolorable toner contains a first resin and a first colorant, and the non-decolorable toner contains a second resin different from the first resin and a second colorant different from the first colorant.

12. The system according to claim 10, wherein the decolorable toner is manufactured by a first method, and the non-decolorable is manufactured by a second method different from the first method.

13. The system according to claim 10, wherein the decolorable toner comprises particles with a first particle diameter, and the non-decolorable toner comprises particles with a second particle diameter different from the first particle diameter.

14. The system according to claim 10, further comprising a heated nip, wherein the toners are fixed on a sheet and the heated nip temperature is maintainable at a fixing temperature of the toners and the decoloring temperature of the decolorable toner.

15. The system of claim 14, further comprising a transport path configured to move sheets within the apparatus from a first location to the heated nip, wherein the belt moves sheets at a constant speed in the direction of the nip when a sheet having a non-colorable toner thereon is fixed in the nip and an immediately subsequent sheet having a fixed decolorable toner image thereon is decolored in the nip.

* * * * *